US006058641A

United States Patent [19]

Vecqueray

[11] Patent Number: 6,058,641

[45] Date of Patent: May 9, 2000

[54] PIVOTABLE BENCH REST FOR SHOOTING A FIREARM

[76] Inventor: Richard C. Vecqueray, P.O. Box 6724, Bend, Oreg. 97708

[21] Appl. No.: 09/163,093

[22] Filed: Sep. 29, 1998

[51] Int. Cl.[7] ..... F41A 23/14; F41A 23/52

[52] U.S. Cl. ..... 42/94; 248/425

[58] Field of Search ..... 42/94; 248/425; 89/37

[56] References Cited

U.S. PATENT DOCUMENTS

| | | | |
|---|---|---|---|
| 1,187,325 | 6/1916 | Ivey | 89/37 |
| 1,639,722 | 8/1927 | Clark | 89/37 |
| 2,079,510 | 5/1937 | King et al. | 89/37 |
| 2,821,117 | 1/1958 | Hultgren | 89/37.01 |
| 3,125,929 | 3/1964 | Peasley | 89/37 |
| 3,225,656 | 12/1965 | Flaherty et al. | 89/37 |
| 3,711,984 | 1/1973 | Dyer et al. | 42/94 |
| 4,266,748 | 5/1981 | Dalton | 248/425 |
| 4,506,466 | 3/1985 | Hall | 42/94 |
| 5,060,410 | 10/1991 | Mueller | 42/94 |
| 5,149,900 | 9/1992 | Buck | 42/94 |
| 5,173,563 | 12/1992 | Gray | 42/94 |
| 5,271,175 | 12/1993 | West | 42/94 |
| 5,287,643 | 2/1994 | Arizpe-Gilmore | 42/94 |
| 5,347,740 | 9/1994 | Rather et al. | 42/94 |
| 5,414,949 | 5/1995 | Peebles | 42/94 |
| 5,421,115 | 6/1995 | McKay | 42/94 |
| 5,481,817 | 1/1996 | Parker | 42/94 |
| 5,491,921 | 2/1996 | Allen | 42/94 |
| 5,715,625 | 2/1998 | West | 42/94 |
| 5,833,308 | 11/1998 | Strong, III et al. | 42/94 |
| 5,884,966 | 3/1999 | Hill et al. | 42/94 |

*Primary Examiner*—Charles T. Jordan
*Assistant Examiner*—Denise J Buckley
*Attorney, Agent, or Firm*—Kolisch Hartwell Dickinson McCormack & Heuser

[57] ABSTRACT

A pivotable bench rest for supporting a shooter aiming a firearm including a seat and support surface configured to rotate in tandem about an axis of rotation that is adjustably alignable into a vertical orientation over uneven terrain.

21 Claims, 2 Drawing Sheets

PIVOTABLE BENCH REST FOR SHOOTING A FIREARM

FIELD OF THE INVENTION

The present invention relates generally to a portable apparatus for shooting firearms. More specifically, the invention concerns a pivotable bench rest for supporting, rotating, and steadying a shooter and a firearm to facilitate aiming at intermittently moving targets at great distances.

BACKGROUND OF THE INVENTION

Bench rests are devices used to support and stabilize a shooter firing a firearm, most typically a rifle. Bench rests are used to sight firearms, as well as to participate in the sport of bench rest shooting. Examples of such support devices can found in U.S. Pat. Nos. 5,715,625 to West, III, 5,414,949 to Peebles, 5,287,643 to Arizpe-Gilmore, 5,271,175 to West, III, 5,173,563 to Gray, 5,149,900 to Buck, 5,060,410 to Mueller, 3,711,984 to Dyer et al., and 3,125,929 to Peasley, the disclosures of which are incorporated herein by reference.

In the sport of bench rest shooting, in its traditional form, a shooter uses a bench rest to fire successive rounds at a stationary target placed at a fixed, known distance. The object of this sport is to hit a specific portion or portions of the target with successive rounds. A shooter's score is measured by the accuracy with which the rounds hit the target. Bench rests for traditional bench rest shooting are typically large metal-framed or concrete benches designed to stabilize the firearm.

A variation of the sport of bench rest shooting at stationary targets has evolved to encompass shooting at multiple and moving targets, including varmints. Traditional bench rests have proved inadequate for multiple or moving targets because of the elaborate steps necessary to realign the rest to aim the firearm in a different direction. Realignment forces the shooter out of a shooting posture, disrupting the aim of the firearm, and takes valuable time, during which the target often moves to a new location.

Some bench rests have been designed for use with multiple and moving targets, by incorporating a pivoting or rotating firearm support. However, in those existing bench rests that have rotating components the axis of rotation does not remain vertical if the bench rest is used on uneven terrain. For example, U.S. Pat. No. 5,060,410 to Mueller discloses a collapsible shooting stand with rotatable components, yet the axis of rotation will tilt depending on the slope of the land on which the stand rests. When the axis of rotation of existing shooting stands is anything but vertical, as is often the case on rough terrain, gravity will cause the components to tend toward the lowest point of rotation. This is an annoyance to the shooter, who occasionally finds himself unintentionally spinning away from his target.

SUMMARY OF THE INVENTION

The present invention typically is in the form of a portable bench rest including the following components: (1) a base; (2) a shaft including a top end, a bottom end, and an axis of rotation, the shaft being mounted to the base adjacent the bottom end of the shaft; (3) a plurality of legs mounted to the base, each leg being adjustable to support the shaft in a vertical orientation over uneven terrain; (4) a seat mounted to the shaft intermediate the top end and the bottom end of the shaft; and (5) a support surface mounted adjacent the top end of the shaft; (6) wherein the seat and the support surface are configured to rotate in tandem about the axis of rotation of the shaft.

To facilitate realignment, a bench rest for shooting multiple and moving targets includes a seat to support the shooter and a support surface for supporting the shooter's arm and a firearm. The seat and support surface rotate or pivot around a central axis in tandem. By pivoting the seat and support surface in tandem, the shooter can maintain his aim while tracking a moving target, and need not break form or alter his position while pivoting from one stationary target to another.

It is desirable that such a pivot motion be steady and even, lest the shooter's aim be interrupted. In addition, the seat and support surface pivot silently, so as not to alert any animals as to the presence of the shooter. The seat and the support surface are adjustable relative to each other and relative to the ground so that the bench rest can accommodate a variety of users. In addition, the bench rest is designed to accommodate both right and left handed users. To ensure that the device only rotates as the shooter desires, the bench rest includes means to keep the axis of rotation vertical over uneven terrain.

Finally, because the shooter frequently must foray into wilderness areas lacking roads in search of a safe area to conduct bench rest shooting, the bench rest of the present invention is relatively lightweight and portable. It folds down to a compact size that it may be carried while hiking. However, the fact that the present bench rest folds down compactly is also helpful when simply transporting the bench rest in a car, truck or other vehicle.

These and other advantages of the invention will be more fully understood by reference to the accompanying drawings and the following detailed description.

DETAILED DESCRIPTION OF THE PREFERRED EMBODIMENT

Figure 1:
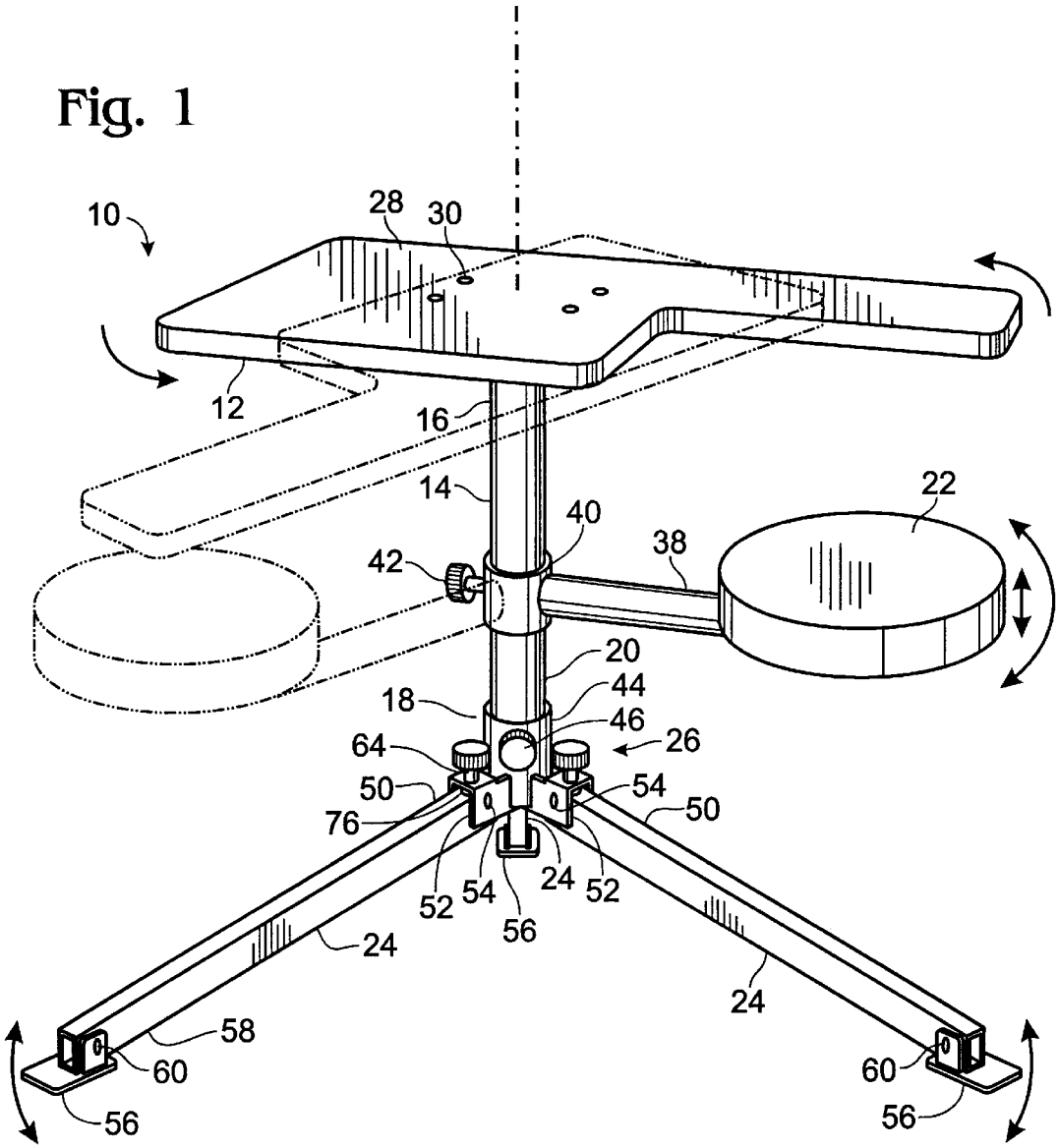
FIG. 1 is an isometric view of a bench rest according to the present invention, taken from the left side and slightly above and behind the bench rest, with a rotated position of the seat and table relative to the legs shown in dashed lines.
Figure 2:
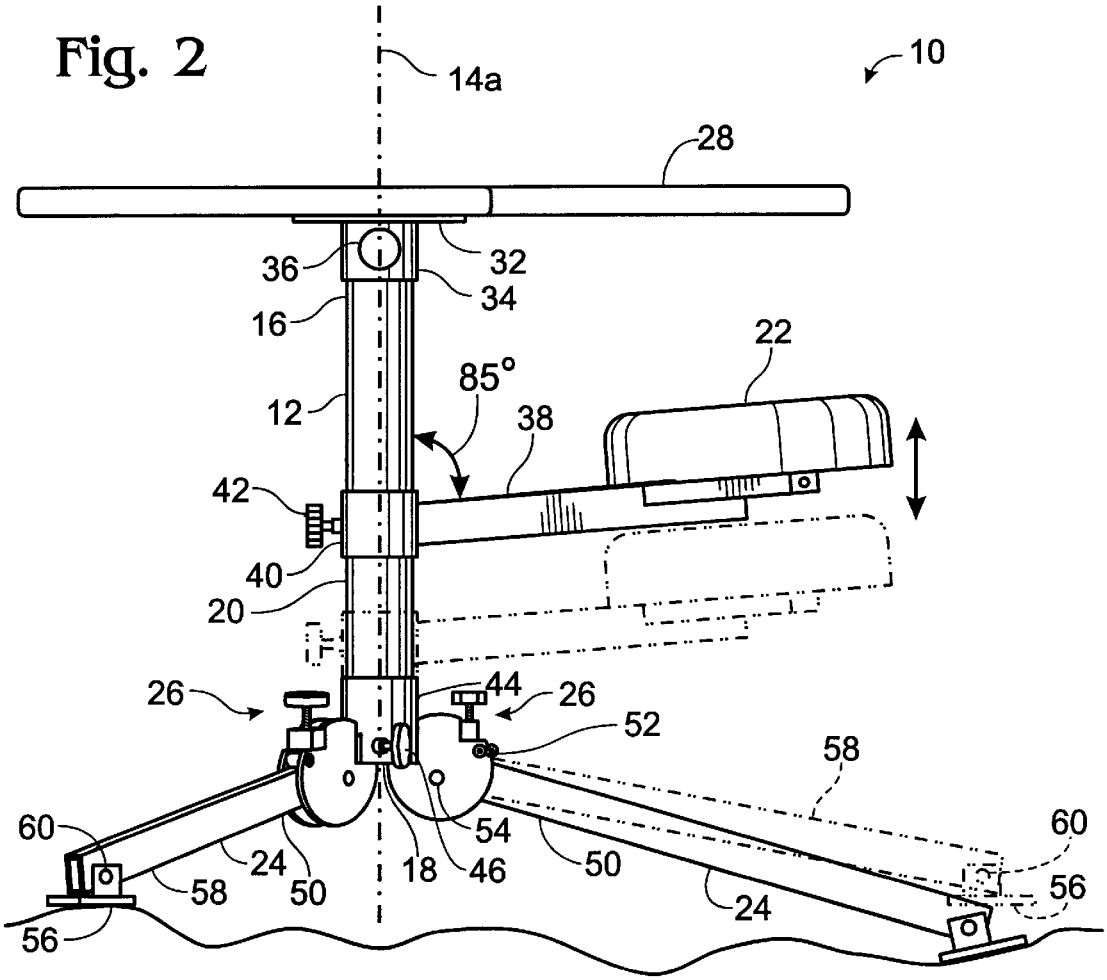
FIG. 2 is a left side elevation of the bench rest of FIG. 1, with an alternate position of the seat relative to the table shown in dashed lines, and with a leg being moved from a normal position in dashed lines to a lowered position to accommodate uneven terrain, shown on approximately the same scale as FIG. 1.

Reference should now be made to FIGS. 1 and 2, which depict an embodiment of a bench rest 10 according to the present invention. Bench rest 10 includes a table or support 12 mounted to a shaft 14 adjacent a top end 16 of shaft 14, a base or hub 18 mounted adjacent a bottom end 20 of shaft 14, and a seat 22 mounted to shaft 14 between support 12 and base 18. Legs 24 support and mount to base 18 by means of couplers 26.

Support 12 includes a preferably L-shaped planar support surface 28 configured to support a shooter's upper body and arms when aiming a firearm. Other configurations of support 12 are envisioned, including supports that simply cradle a firearm, and supports that incorporate holders or cradles for other articles such as drinks, ammunition and telescopes. As shown in FIG. 2, screws 30 extend through support surface 28 and attach to a mounting plate 32. Support surface 28 can be reversibly mounted to mounting plate 32 to accommodate both left handed and right handed users. Mounting plate 32 preferably is welded to a collar 34, which mounts directly to shaft 14. Collar 34 rotates freely on shaft 14, but can be locked in place on shaft 14 by means of a set screw 36, fixing the orientation of support surface 28 relative to shaft 14.

Seat 22 is mounted to shaft 14 between top end 16 and bottom end 20 by means of an arm 38 and a collar 40. Collar 40 slides along and rotates freely on shaft 14, but can be locked in place by means of a set screw 42, fixing the orientation of seat 22 relative to shaft 14. By raising or lowering seat 22 on shaft 14, and rotating either support surface 28 or seat 22 relative to each other about shaft 14, the relative orientation of support surface 28 to seat 22 may be adjusted in both the vertical direction along shaft 14 as shown in dashed lines in FIG. 2, and in a rotational direction about shaft 14, not shown. Once the desired relative orientation is achieved, set screws 36 and 42 are used to lock support surface 28 and seat 22 in place.

It will be noted that in FIG. 1, arm 38 is shown as a tubular beam extending at approximately a right angle to shaft 14, while in FIG. 2, arm 38 is shown as a rectangular beam extending at an angle of approximately 95-degrees to shaft 14, in a slightly upward direction. The rectangular shaft has been found to be somewhat easier to weld to sleeve 40, and is believed to be lighter and stronger. The upward tilt of arm 38 relative to shaft 14 biases seat 22 toward support 12. This bias is believed to improve the position of a shooter using bench rest 10, and is more comfortable for the shooter. It also compensates for any play or bending that occurs within arm 38 or the joining of sleeve 40 to shaft 14, so that a shooter does not feel as if seat 22 is tilting away from support 12.

Base 18 includes a sleeve 44 configured to receive and support bottom end of shaft 14. Shaft 14 is free to rotate within sleeve 44, but can be locked in place by means of a set screw 46. When set screws 36 and 42 are locked, and set screw 46 is unlocked, support 12 and seat 22 are free to rotate in tandem about axis of rotation 14*a*, as shown in dashed lines in FIG. 1. Preferably the bottom end 20 of shaft 14 rests against an ultra-high molecular weight polymer band or bearing 48, shown in FIG. 3, positioned within or adjacent to sleeve 44 to ensure smooth and silent rotation of shaft 14 within sleeve 44. Band 48 also may be made of Nylatron.

Figure 3:
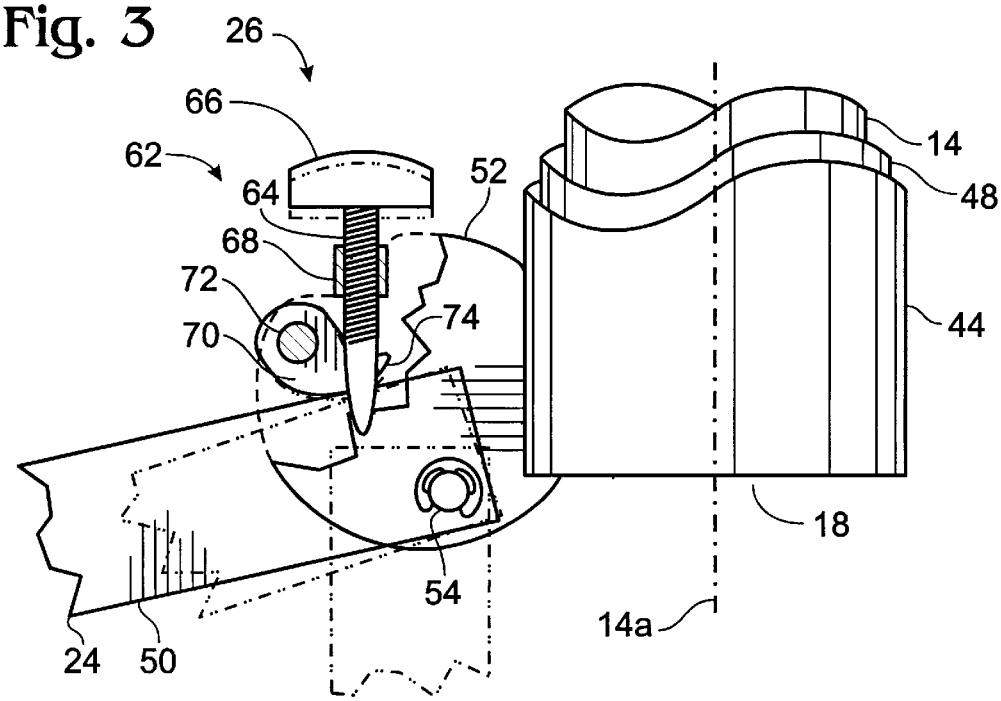
FIG. 3 is an enlarged detailed view of a hinge of the bench rest joining a leg of the bench rest to a base, with movement of the leg about the hinge shown in dashed lines.

As shown in FIG. 3, legs 24 pivotally mount to base 18 by means of couplers 26. Each of couplers 26 includes a post 50 pivotally mounted to a receptacle 52 by means of a pin 54. Preferably, post 50 is an inner end 50 of a leg 24 and receptacle 52 is a bracket 52 mounted to base 18. In another embodiment of the invention, not shown, post 50 may extend from base 18 and receptacle 52 may be formed as part of leg 24. A foot 56 is mounted pivotally to a distal end 58 of each leg 24 by means of a pin 60.

As shown in FIG. 3, legs 24 preferably are free to pivot between a collapsed orientation substantially parallel to axis 14*a*, and a radially extended orientation in which legs 24 extend horizontally or at an angle away from base 18. The angle of at least one leg 24, and preferably each of legs 24, relative to base 18 in the extended orientation is adjustable by means of an angle adjuster 62. Preferably, angle adjuster 62 is a stop screw 64 including a handle 66, threaded through a nut 68 formed or mounted to bracket 52.

The adjusting movement of stop screw 64 may be amplified, as shown in FIG. 3. In the preferred embodiment, an amplifier is provided in the form of a cam 70 mounted within bracket 52 to rotate about a cam pin 72. A wiper 74 extends outwardly from cam 70 relative to cam pin 72, and is pushed toward leg 24 by stop screw 64. The force exerted on leg 24 by stop screw 64 is amplified, with a large amount of movement of stop screw 64 resulting in a small amount of movement of wiper 74 relative to leg 24. The rounded shape of cam 70 has been found to provide a reliably movable bearing surface interposing leg 24 and stop screw 64.

In FIG. 1, stop screw 64 is shown without an amplifier. In this embodiment, stop screw 64 terminates in a stopper 76 that is mounted to stop screw 64 by means of a ball joint. Other adjustable stops may be used, and stop screw 64 may be reversed so that screw 64 is treaded through post 50 to bear against bracket 52. However, the embodiments shown in the drawings have been found to be reliable, easy to use, and relatively inexpensive to make.

By individually adjusting the angle of declination of at least one and preferably each leg 24 by means of stop screws 64, the user can keep axis of rotation 14*a* of shaft 14 in a vertical orientation, as shown in FIG. 2, thereby improving tandem rotation of seat 22 and support surface 28 about axis 14*a*. For example, one of feet 56 may be located above a low spot, in which case angle adjuster 62 is used to lower leg 24, as shown in FIG. 3. The amplification of the movement of stop screw 64 provided by cam 70 makes adjustments of legs 24 quicker to perform, and allows for a wider range of motion of distal ends 58 of legs 24 relative to hub 18, accommodating greater variations in terrain.

While the invention has been disclosed in its preferred form, it is to be understood that any specific embodiment disclosed and illustrated herein is not to be considered in a limiting sense. Numerous variations are possible and no single feature, function, or property of the preferred embodiment is essential. The invention is to be defined only by the scope of the issued claims.

What is claimed is:

1. A bench rest for aiming a firearm, comprising:

a base;

a shaft including a top end, a bottom end, and an axis of rotation, the shaft being mounted to the base adjacent the bottom end of the shaft;

a plurality of legs mounted to the base, at least one of the legs being adjustable to align the shaft in a vertical orientation over uneven terrain;

a seat mounted to the shaft intermediate the top end and the bottom end of the shaft;

a support surface mounted adjacent the top end of the shaft;

a plurality of receptacles formed in the base, each receptacle pivotally receiving a respective leg and being configured to accommodate rotation of the respective leg from a collapsed orientation into an extended orientation relative to the base and to support the respective leg in the extended orientation; and a stop screw attached to at least one of the receptacles to stop and support a respective leg in the extended orientation at an adjustable angle relative to the base.

2. The bench rest according to claim 1, further comprising an amplifier interposed the stop screw and the respective leg to amplify movement of the respective leg in response to movement of the stop screw.

3. The bench rest according to claim 1, further comprising a cam interposed the stop screw and the respective leg to amplify movement of the respective leg in response to movement of the stop screw.

4. The bench rest according to claim 1, further comprising a cam pivotally mounted to the at least one of the receptacles, interposed the stop screw and the respective leg to amplify movement of the respective leg in response to movement of the stop screw.

5. The bench rest according to claim 1, further comprising a cam mounted to the at least one of the receptacles about a pivot, the cam including a wiper extending outwardly relative to the pivot and being interposed the stop screw and the respective leg to amplify movement of the respective leg in response to movement of the stop screw.

6. A bench rest for aiming a firearm, comprising:

a base;

a shaft including a top end, a bottom end, and an axis of rotation, the shaft being mounted to the base adjacent the bottom end of the shaft;

a plurality of legs mounted to the base, at least one of the legs being adjustable to align the shaft in a vertical orientation over uneven terrain;

a seat mounted to the shaft intermediate the top end and the bottom end of the shaft; and a support surface mounted adjacent the top end of the shaft;

wherein the seat is tilted toward the support surface.

7. A bench rest for aiming a firearm, comprising:

a base;

a shaft including a top end, a bottom end, and an axis of rotation, the shaft being mounted to the base adjacent the bottom end of the shaft;

a plurality of legs mounted to the base, at least one of the legs being adjustable to align the shaft in a vertical orientation over uneven terrain;

a seat mounted to the shaft intermediate the top end and the bottom end of the shaft; and a support surface mounted adjacent the top end of the shaft;

wherein the seat is vertically adjustable relative to the support surface.

8. A bench rest for supporting a shooter aiming a firearm, comprising:

a shaft;

a seat mounted to the shaft the seat being configured to support a shooter;

a support surface mounted to the shaft, the support surface being configured to support and stabilize an arm of the shooter and a firearm to facilitate aiming and firing of the firearm;

means for rotating the seat and the support surface in tandem about an axis of rotation; and means for adjustably aligning the axis of rotation in a vertical orientation over uneven terrain;

wherein the seat is tilted toward the support surface.

9. A support device for supporting a shooter aiming a firearm, comprising:

a base including a sleeve and a plurality of brackets extending radially from the sleeve;

a plurality of legs, each leg being pivotally mounted to a respective bracket and configured to pivot from a collapsed orientation to a radially extended orientation, the plurality of legs being configured to support the base over a surface in the radially extended orientation;

a shaft including a top end and a bottom end, the shaft being rotatably mounted within the sleeve adjacent the bottom end;

an adjustable stop attached to a respective bracket and configured to support a respective leg at an adjustable angle relative to the shaft in the extended orientation;

a seat for supporting a shooter, the seat mounted to the shaft between the bottom end and the top end; and a support for aiming a firearm, the support mounted adjacent the top end of the shaft, wherein the adjustable stop includes an amplifier interposed a stop screw and the respective leg to amplify movement of the respective leg in response to movement of the stop screw.

10. A support device for supporting a shooter aiming a firearm, comprising:

a base including a sleeve and a plurality of brackets extending radially from the sleeve;

a plurality of legs, each leg being pivotally mounted to a respective bracket and configured to pivot from a collapsed orientation to a radially extended orientation, the plurality of legs being configured to support the base over a surface in the radially extended orientation;

a shaft including a top end and a bottom end, the shaft being rotatably mounted within the sleeve adjacent the bottom end;

an adjustable stop attached to a respective bracket and configured to support a respective leg at an adjustable angle relative to the shaft in the extended orientation;

a seat for supporting a shooter, the seat mounted to the shaft between the bottom end and the top end; and a support for aiming a firearm, the support mounted adjacent the top end of the shaft;

wherein the adjustable stop includes a cam interposed a stop screw and the respective leg to amplify movement of the respective leg in response to movement of the stop screw.

11. A support device for supporting a shooter aiming a firearm, comprising:

a base including a sleeve and a plurality of brackets extending radially from the sleeve;

a plurality of legs, each leg being pivotally mounted to a respective bracket and configured to pivot from a collapsed orientation to a radially extended orientation, the plurality of legs being configured to support the base over a surface in the radially extended orientation;

a shaft including a top end and a bottom end, the shaft being rotatably mounted within the sleeve adjacent the bottom end;

an adjustable stop attached to a respective bracket and configured to support a respective leg at an adjustable angle relative to the shaft in the extended orientation;

a seat for supporting a shooter, the seat mounted to the shaft between the bottom end and the top end; and a support for aiming a firearm, the support mounted adjacent the top end of the shaft;

wherein the adjustable stop includes a cam pivotally mounted to the respective bracket, interposed the stop screw and the respective leg to amplify movement of the respective leg in response to movement of the stop screw.

12. A support device for supporting a shooter aiming a firearm, comprising:

a base including a sleeve and a plurality of brackets extending radially from the sleeve;

a plurality of legs, each leg being pivotally mounted to a respective bracket and configured to pivot from a collapsed orientation to a radially extended orientation, the plurality of legs being configured to support the base over a surface in the radially extended orientation;

a shaft including a top end and a bottom end, the shaft being rotatably mounted within the sleeve adjacent the bottom end;

an adjustable stop attached to a respective bracket and configured to support a respective leg at an adjustable angle relative to the shaft in the extended orientation;

a seat for supporting a shooter, the seat mounted to the shaft between the bottom end and the top end; and a support for aiming a firearm, the support mounted adjacent the top end of the shaft;

wherein the adjustable stop includes a cam mounted to the respective bracket about a pivot, the cam including a wiper extending outwardly relative to the pivot and being interposed a stop screw and the respective leg to amplify movement of the respective leg in response to movement of the stop screw.

13. A support device for supporting a shooter aiming a firearm, comprising:

a base including a sleeve and a plurality of brackets extending radially from the sleeve;

a plurality of legs, each leg being pivotally mounted to a respective bracket and configured to pivot from a collapsed orientation to a radially extended orientation, the plurality of legs being configured to support the base over a surface in the radially extended orientation;

a shaft including a top end and a bottom end, the shaft being rotatably mounted within the sleeve adjacent the bottom end;

an adjustable stop attached to a respective bracket and configured to support a respective leg at an adjustable angle-relative to the shaft in the extended orientation;

a seat for supporting a shooter, the seat mounted to the shaft between the bottom end and the top end; and a support for aiming a firearm, the support mounted adjacent the top end of the shaft;

wherein the seat is tilted toward the support surface.

14. A bench rest for use in aiming a firearms, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs;

an angle adjuster to adjust and limit the angle of at least one of the legs to the shaft, wherein the angle adjuster is a stop screw threaded through a portion of a receptacle; and an amplifier interposed the stop screw and a respective leg to amplify movement of the respective leg in response to movement of the stop screw.

15. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs;

an angle adjuster to adjust and limit the angle of at least one of the legs to the shaft, wherein the angle adjuster is a stop screw threaded through a portion of a receptacle; and a cam interposed the stop screw and a respective leg to amplify movement of the respective leg in response to movement of the stop screw.

16. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs;

an angle adjuster to adjust and limit the angle of at least one of the legs to the shaft, wherein the angle adjuster is a stop screw threaded through a portion of a receptacle; and a cam pivotally mounted to the receptacle, interposed the top screw and a respective leg to amplily movement of the respective leg in response to movement of the stop screw.

17. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs;

an angle adjuster to adjust and limit the angle of at least one of the legs to the shaft, wherein the angle adjuster is a stop screw threaded through a portion of a receptacle; and a cam mounted to the receptacle about a pivot, the cam including a wiper extending outwardly relative to the pivot and being interposed the stop screw and a respective leg to amplify movement of the respective leg in response to movement of the stop screw.

18. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs; and an angle adjuster to adjust and limit the angle of at least one of the legs to the shaft;

wherein the angle adjuster is a stop screw threaded through a portion of the leg.

19. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs; and an angle adjuster to adjust and limit the angle of at least one of the legs to the shaft;

wherein the shaft is held by the legs in an approximately vertical position.

20. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs; and an angle adjuster to adjust and limit the angle of at least one of the legs to the shaft;

wherein the seat is tilted toward the support.

21. A bench rest for use in aiming a firearm, comprising:

a plurality of legs having spaced apart outer ends for resting on a surface;

a shaft held by the legs adjacent a bottom of the shaft;

a support for supporting a firearm, mounted to the shaft adjacent a top of the shaft;

a seat operatively supported by the legs;

an angle adjuster to adjust and limit the angle of at least one of the legs to the shaft;

a hub mounted to the bottom of the shaft about a bearing; and a receptacle connected to the hub, with an inner end of one of the legs pivotally mounted within the receptacle;

wherein the angle adjuster is a stop screw threaded through the inner end of the one of the legs.

* * * * *